US005127028A

United States Patent [19]

Wittry

[11] Patent Number: 5,127,028

[45] Date of Patent: Jun. 30, 1992

[54] DIFFRACTORD WITH DOUBLY CURVED SURFACE STEPS

[76] Inventor: David B. Wittry, 1036 S. Madison Ave., Pasadena, Calif. 91106

[21] Appl. No.: 561,715

[22] Filed: Aug. 1, 1990

[51] Int. Cl.[5] ..... G21K 1/06

[52] U.S. Cl. ..... 378/84; 378/81; 378/85

[58] Field of Search ..... 378/84, 85, 81, 82, 378/70

[56] References Cited

U.S. PATENT DOCUMENTS

| | | | |
|---|---|---|---|
| 3,469,098 | 9/1969 | Okano . | |
| 3,927,319 | 12/1975 | Wittry . | |
| 4,599,741 | 7/1986 | Wittry . | |
| 4,807,268 | 2/1989 | Wittry . | |
| 4,882,780 | 11/1989 | Wittry . | |
| 4,916,721 | 4/1990 | Carr et al. | 378/84 |
| 4,949,367 | 8/1990 | Huizing et al. | 378/84 |

OTHER PUBLICATIONS

D. B. Wittry, Songquan Sun, X-ray Optics of Doubly Curved Diffractors, 15, Feb. 1990, J. Appl. Phys, vol. 67, pp. 1633-1638.

D. B. Wittry, Songquan Sun, Focussing Properties of Curved X-ray Diffractors, 15, Jul. 1990, J. App. Phys. vol. 69, pp. 387-391.

D. B. Wittry and S. Sun, J Appl. Phys. 69, 3886-3892 (1991).

L. S. Birks, Electron Probe Microanalysis, 2nd ed. pp. 46-51 (1971).

E. P. Bertin, Principles and Practice of X-Ray Spectrometric Analysis pp. 200-210 (1975).

D. W. Berreman, J. Stamatoff, and S. M. Kennedy, Applied Optics 77, 2081-2085 (1977).

D. B. Wittry and D. M. Golijanin, Appl. Phys. Lett. 52 1381-1382 (1988).

*Primary Examiner*—Janice A. Howell
*Assistant Examiner*—David P. Porta

[57] ABSTRACT

A diffractor for energetic electromagnetic radiation has diffracting planes oriented parallel to the surface of steps which have a doubly curved surface. The steps are configured so that the resulting diffractor approximates the Johansson geometric conditions in the plane of the focal circle of radius r. The steps are additionally curved in a direction perpendicular to the focal circle in order to provide for satisfying Bragg's law for diffraction over the maximum area of the diffractor. The curvature of the planes perpendicular to the focal circle corresponds to rotating the stepped approximation to the Johansson geometry about an axis passing through the source and image points. The diffracting materials are thin sheets of doubly curved single crystal stacked together, thin sheets of single crystal material mounted on the doubly curved surfaces of the steps, pieces or flakes of single crystal material mounted on the doubly curved surfaces of the steps or layered synthetic microstructures deposited on the doubly curved surfaces of the steps.

16 Claims, 3 Drawing Sheets

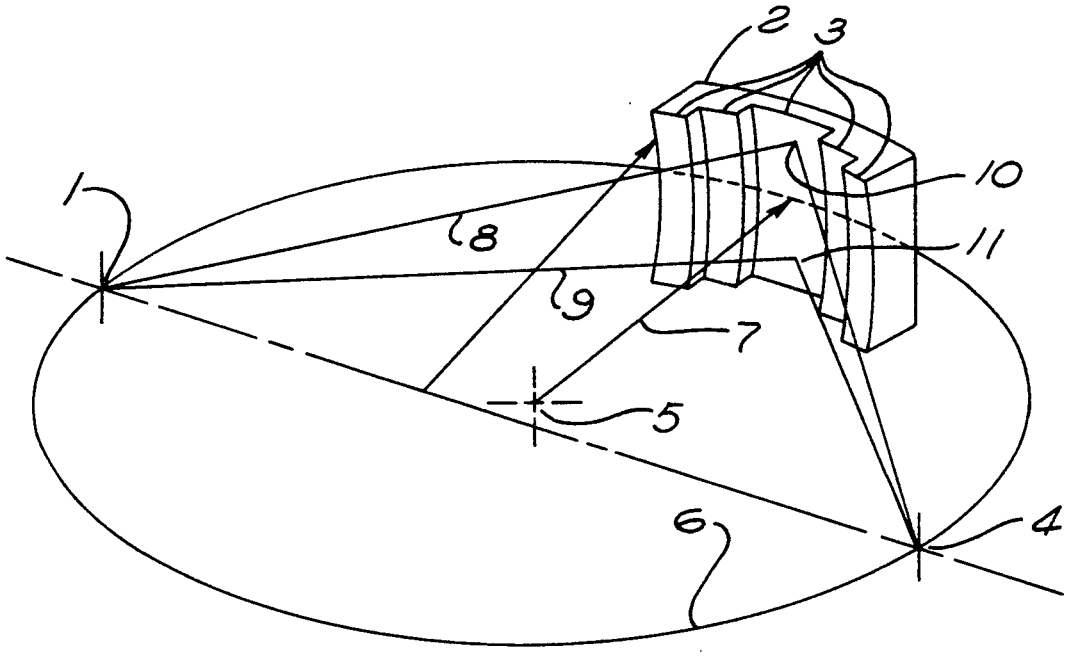
FIG. 1A
FIG. 1B
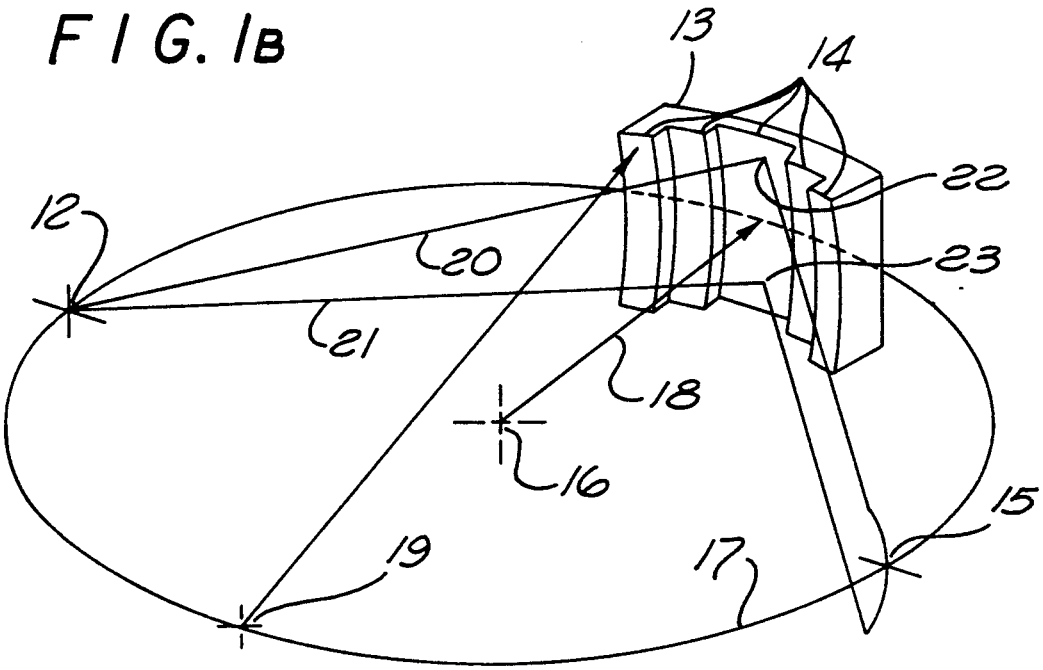

DIFFRACTORD WITH DOUBLY CURVED SURFACE STEPS

BACKGROUND OF THE INVENTION

Efficient x-ray diffractors having a large collection solid angle and high spectral resolving power have surfaces and planes that are cylindrically curved to different radii as in the Johansson geometry, or are doubly curved as in the spherically bent plate or in diffractors with spherical planes and toroidal surface. However, the ideal geometries involving doubly curved diffracting planes and surfaces that are curved differently than the planes cannot always be used for diffractors fabricated from bulk single crystals for several reasons. First, natural crystal are not available with sufficiently large d spacings to diffract long wave length x rays. Second, some natural crystals with desirable d spacings and high diffraction efficiency cannot be formed to the desired configuration because of difficulty in grinding or polishing the surfaces that are not parallel to cleavage planes or because of the tendency to fracture when elastic bending is used or because of the undesirable distortion of the crystal lattice if plastic bending is used. The latter problems are enhanced when using thick pieces of single crystals to form large area diffractors because of the greater stresses produced in bending. On the other hand, layered structures obtained by multiple deposition processes have not yet been made with sufficiently small d spacings to diffract x-rays of short wave length at large Bragg angles and have not been made sufficiently thick to be configurable to the desired geometry.

The purpose of the present invention is to provide a diffractor geometry with a stepped surface that will increase the possible ways for fabricating large area, high efficiency diffractors and will increase the variety and types of diffracting materials that can be used in the fabrication of these diffractors.

SUMMARY OF THE INVENTION

This invention is a diffractor with surface steps configured to approximate the case wherein the diffractor has doubly curved diffracting planes and a smooth doubly curved surface on the side on which the radiation impinges. Such doubly curved diffractors have been described by Wittry and Sun in the Journal of Applied Physics, Feb. 15, 1990, pages 1633–1638, and by Wittry in U.S. Pat. Nos. 4,599,741 (Jul. 8, 1986), 4,807,268 (Feb. 21, 1989), and 4,882,780 (Nov. 21, 1989). The stepped diffractor is configured so that the surface of the steps have the same shape as the diffracting planes of the continuous case. Thus, the diffracting material has diffracting planes parallel to the surface of the steps. This makes it possible to fabricate doubly curved diffractors of high radiation collection efficiency using diffracting materials that cannot normally be employed in the fabrication of high efficiency diffractors having a continuous and smooth surface.

For the diffractor with doubly curved surface steps, two factors govern the width of the steps for a useful diffractor, namely, a) the effect of the width of the steps on satisfying Bragg's law within a certain range of the desired value of the diffracting angle $\theta_B$, and b) the effect of the finite width of the steps on the focussing properties of the diffractor. As will be shown in the section on embodiments of the invention, relatively simple equations can be derived that show these relationships and indicate how the step width should vary over the surface of the diffractor in order to satisfy the constraints imposed by both the rocking curve width of the diffracting material and the desired focussing accuracy.

Although stepped diffractors have been previously proposed as approximations to the Johannson geometry by Okano in U.S. Pat. No. 3,469,098 (Sep. 23, 1969) and by Wittry in U.S. Pat. No. 3,927,319 (Dec. 16, 1975), neither of these inventions took into consideration the true effects resulting from the three dimensional nature of the problem of diffracting as much radiation as possible emanating from a point source. With the results of calculations of the type made by Wittry and Sun in their 1990 Journal of Applied Physics paper it is possible to see the advantages of diffractors with doubly curved planes and doubly curved surfaces. The unique problems that occur in the fabrication of these latter types of diffractors, which were discovered only by considerable experimentation, has led to the present invention in which the steps on the diffractor have a doubly curved surface.

BRIEF DESCRIPTION OF THE DRAWINGS

The forgoing features of the invention and its advantages can be understood more fully from the following detailed description and the accompanying drawings. These drawings may be briefly listed as follows:

FIG. 1 includes two isometric views showing the relationship of the diffractor with doubly curved surface steps to the x-ray source, the x-ray image and the focal circle. FIG. 1A shows a case in which the curvature of the surfaces of the steps corresponds to rotating a stepped approximation to the Johannson geometry about a line joining the source and image for a particular Bragg angle. FIG. 1B shows a special case in which the diffractor is configured as if the source and image point were to coincide; i.e. the surfaces of the steps are curved in a direction perpendicular to the plane of the focal circle with a radius of curvature approximately twice the radius of focal circle.

DESCRIPTION OF PREFERRED EMBODIMENTS

Figure 2:
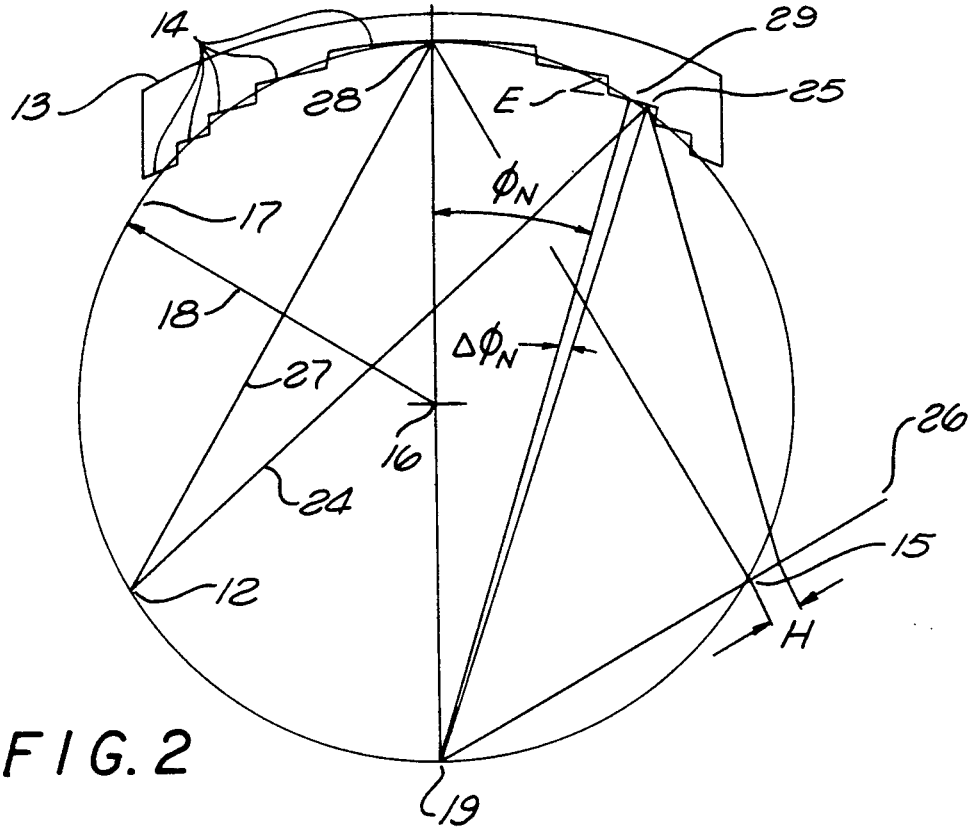
FIG. 2 shows a plan view in the plane of the focal circle defining some of the quantities used in the equations given in the following section.

Referring now to the drawings, FIG. 1A shows the spatial relationship between a radiation source 1 and a diffractor 2 constructed according to a preferred embodiment of the present invention. The diffractor 2 has steps 3 whose surfaces are doubly curved. For purposes of illustration, the diffractor 2 is shown with only a few steps and the height of the steps is exaggerated. The radiation from the source 1 is diffracted to an image point 4. The source 1, diffractor 2 and image point 4 are equidistant from the center 5 of a focal circle 6. This relationship is assured by the fact that the steps 3 are configured so that in the plane of the focal circle 6 they form an approximation to the Johansson geometry which will be described later in conjunction with FIG. 2. In this approximation to the Johansson geometry, the intercepts of the curved surfaces of the steps with the plane of the focal circle correspond to circular arcs of radius substantially equal to twice the radius of the focal circle. Convergence of rays 8 and 9 after diffraction at points 10 and 11 respectively is obtained by configuring the diffractor so that it is rotationally symmetric about a line passing through the source 1 and the image point 4. The radius of the surface of the steps in a plane perpendicular to the focal circle will be a function of the Bragg angle. Hence, the surface of the steps will have the shape of a toroid in the general case when $O_B$ is less than 90. Since the geometry of FIG. 1A focusses monochromatic radiation from a point source 1 to a point image 4, it is useful for isolating a particular wave length of radiation, or for concentrating radiation of a particular wave length at the image point.

While the geometry of FIG. 1A is most useful for radiation of a specific wavelength, it is not generally useful if the same diffractor must be used for radiation of various wave lengths. A second preferred embodiment of the invention which is more useful for the latter application is shown in FIG. 1B. In FIG. 1B, radiation from a source 12 striking the diffractor 13 at the surface of the steps 14 is brought to a curvilinear image 15. As in FIG. 1A, the source 12, diffractor 13, and the image 15 are substantially equidistant from the center 16 of a focal circle 17 whose radius is given by the vector 18. In this case, the steps are spherically curved about a point 19 which also lies on the focal circle 17. It can be seen that this geometry corresponds to the one shown in FIG. 1A if the source and image points were to coincide at the point 19.

While it might seem that the configurations shown in FIG. 1A and FIG. 1B are similar to those employed for diffraction of light radiation, this is not actually true because for energetic electromagnetic radiation such as x rays, gamma rays, etc. the diffraction process and the diffraction equations are different from those involved in the optical case. Bragg's law for diffraction of energetic radiation results by considering the scattering of rays lying below the surface rather than at the surface only; this imposes an additional condition, not present for optical diffractors, namely that the angle of incidence is equal to the angle of diffraction. Additionally, in the present case, the appropriate spacing constant for energetic radiation is the spacing of the diffracting planes and not the spacing between the steps on the surface of the diffractor as is true for optical diffractors. The distinction between the present invention and optical diffractors is made in the claims that follow by using the term "Bragg diffractor" which means a diffractor whose properties are governed by Bragg's law, namely: $n\lambda = 2d(\sin \theta_B)$ where n is the order of diffraction, $\lambda$ is the wave length, $\theta_B$ is the Bragg angle, and d is the spacing of the diffracting planes.

FIG. 2 shows the geometry of the focal circle and the section of the stepped diffractor lying in the plane of the focal circle. As in FIG. 1B, the source 12, diffractor 13 with steps 14, and image 15 lie on the focal circle 17 whose radius is 18 and whose center is at 16. A ray 24 incident on a step at point 25 strikes the image plane 26 at a distance H from the point where a ray 27 diffracted from the center 28 of the diffractor 13 would intercept the image plane. Angular coordinate $\phi_N$ measures the position of the midpoint of the Nth step about the center of curvature 19 of the steps relative to the midpoint 28 of the diffractor. Angular coordinate $\Delta\phi_N$ measures the position of the point 25 on the Nth step relative to the midpoint 29 of the step.

For the conditions shown in FIG. 2, if the angle of incidence of the ray 27 relative to the diffracting planes at the midpoint 28 of the diffractor is the Bragg angle $\theta_B$, then the angle of incidence of a ray striking the midpoint of every step is also equal to $\theta_B$ if the midpoint of every step lies on the focal circle 17. This follows from the Johansson geometry if the surface of every step is a Bragg diffractor with planes parallel to the surface of the step.

The condition that the midpoint of the surface of the Nth step lies on the focal circle yields an equation for the surface of the Nth step, namely:

$$\cos \phi_N = (1 - NE + E) \qquad \text{(Eq. 1)}$$

where E is the step height in normalized coordinates (actual coordinates divided by 2 r where r is the radius of the focal circle) and N is the number of the step ranging from 1 to M with M = the number of steps on each side of the center of the diffractor. While all steps are considered to be of equal height in this example, it is clear that this is not a necessary condition but merely a convenience for calculation which may also simplify the fabrication of the diffractor.

If the focal circle passes through the step along its height at 0.5E as shown in FIG. 2, the equation for the edge of the Nth step is:

$$\cos \phi_N' = (1 - NE + E/2) \qquad \text{(Eq. 2)}$$

Also, if the deviation of the angle of incidence relative to the Bragg angle is given by $\Delta\theta = \theta - \theta_B$, it may be shown that for a ray such as 24:

$$\Delta\theta = [\Delta\phi_N \tan \phi_N][\tan \theta_B - \tan \phi_N]^{-1} \qquad \text{(Eq. 3)}$$

For optimum use of the diffractor's surface $\Delta\theta$ should lie within the rocking curve of the diffracting material that is used. This is one of the two requirements that must be satisfied in the design of high efficiency diffractors that utilize various diffracting materials.

A second consideration which may be important in some applications is the effect of the step width on the focus aberration H. For rays lying in the plane of the focal circle, H is given (in normalized coordinates) by the following equation:

$$H = \cos(\theta_B + \Delta\theta) \cos(\phi_N) / \cos(\phi_N + \Delta\phi_N + \Delta\theta) - \cos(\theta_B) \qquad \text{(Eq. 4)}$$

This equation applies for both of the cases shown in FIG. 1, since the only difference between these two cases is the curvature of the surface of the steps perpendicular to the focal circle.

Figure 3:
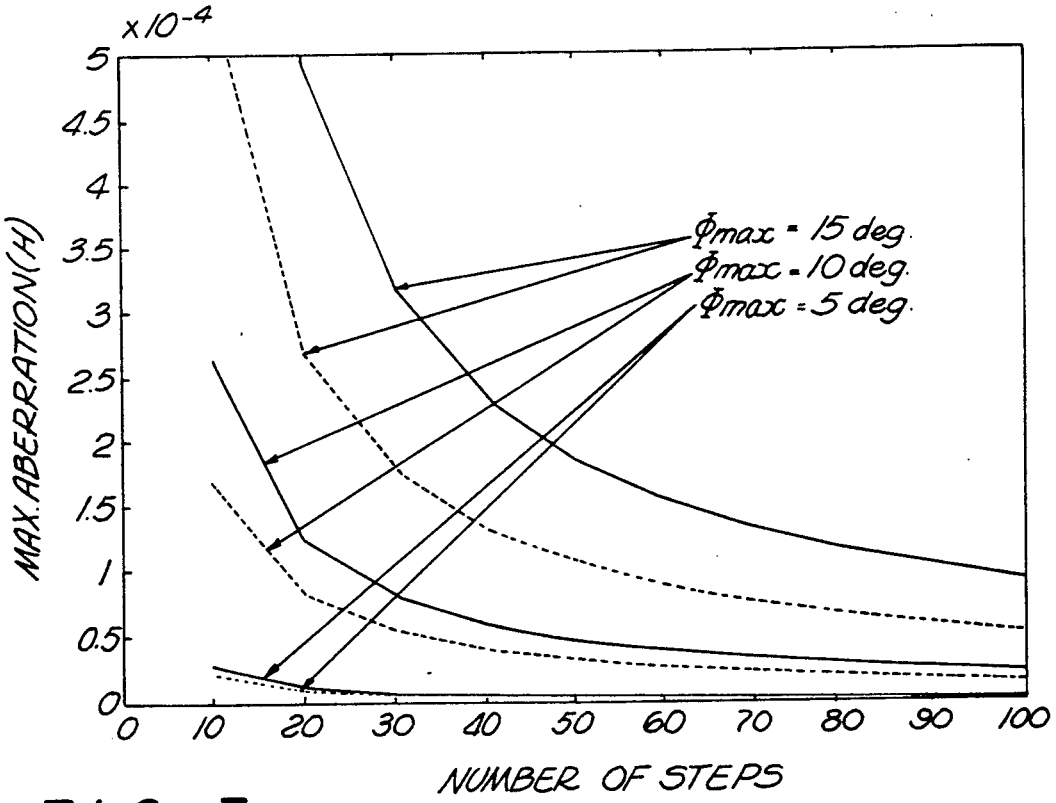
FIG. 3 shows a graphical relationship of the maximum deviation from the correct focus for rays diffracted from steps of the diffractor as a function of the number of steps on the surface of the diffractor.

Equations 3 and 4 are used in the practical design of diffractors in order to determine the number of steps required for a diffractor of given size. If maximum use of the diffractor's are is of major concern, Eq. 3 would be used to determine the minimum useful value of $\Delta\phi_N$ and hence the maximum number of steps required. On the other hand, if the focussing aberration is the major concern, the minimum number of steps required would be obtained by use of Eq. 4, from which it is expected that a larger number of steps would yield smaller focussing aberrations. For example, a plot based on Eq. 4, which is shown in FIG. 3 gives the maximum value of H as a function of the number of steps for diffractors of three different size denoted by $\theta_{max}$. The maximum value of H applies to the steps furthest from the midpoint 28 of the diffractor. Note that Eq. 4 is not symmetric with respect to $\phi_N$ so that two sets of curves are shown; the solid lines apply for positive values of $O_N$ while the dashed lines apply for negative values of $\phi_N$.

Figure 4:
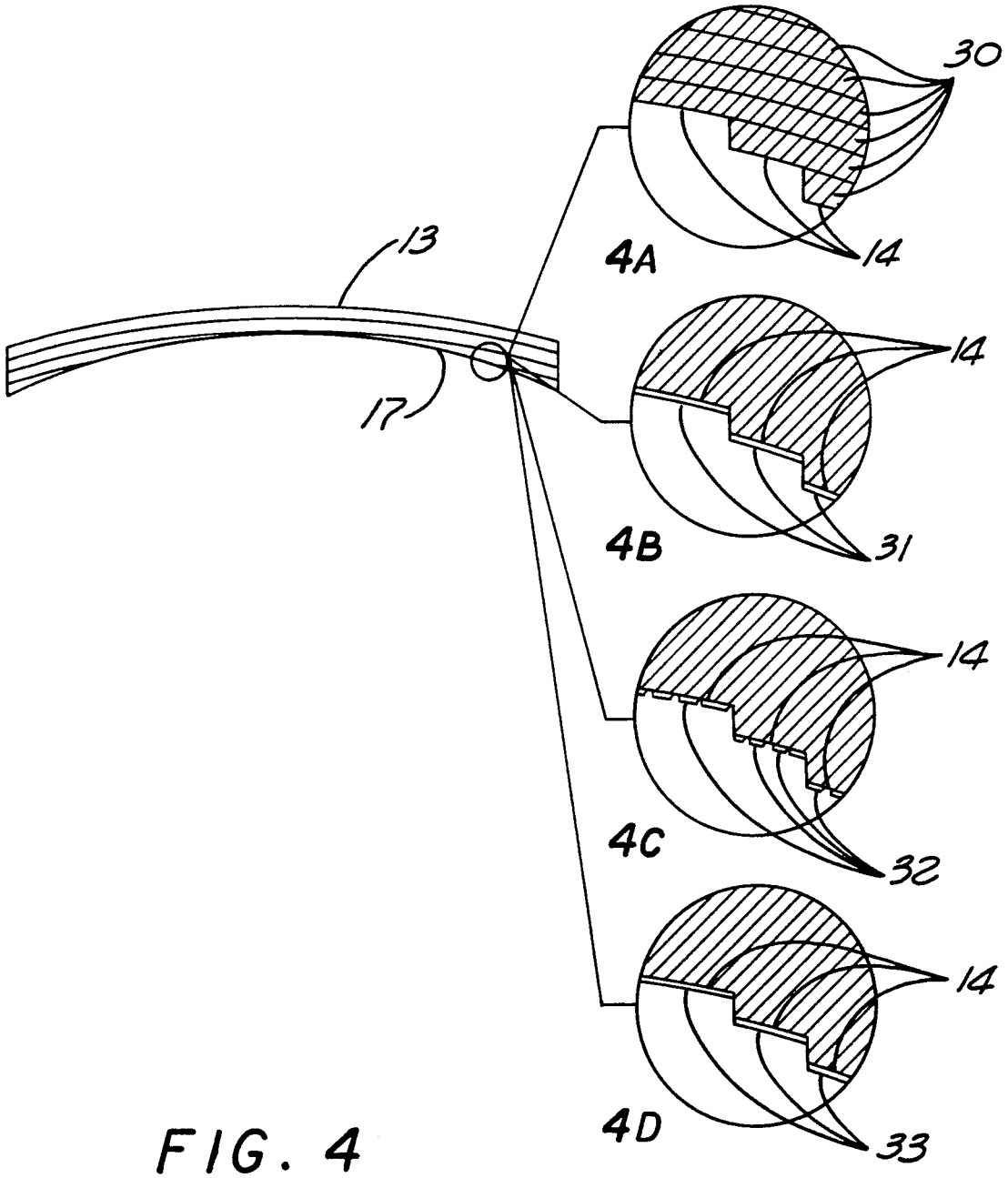
FIG. 4 shows in 4A, 4B, 4C, and 4D, examples of four structures for a stepped diffractor having doubly curved surfaces wherein different fabrication methods are used.

FIG. 4 shows four examples of preferred embodiments of the diffractor structure. In FIG. 4A a diffractor is shown that consists of thin layers of single crystal material 30 which have been bent to the shape of a spherical or toroidal shell and then stacked together. While plastic bending of the thin layers may be used, elastic bending is preferred (in order to minimize the width of the rocking curve) and may be used for diffractors having sufficiently small size or sufficiently large bending radius. This is advantageous for cases where very thin sheets of bulk crystal material are easily made (e.g. silicon) or cases where the single crystal material occurs naturally in the form of thin sheets (e.g. mica) which cannot be ground and polished without fraying or being damaged in other ways. This type of diffractor is also useful as a substrate for some of the other diffractors with stepped surface that are formed by applying diffracting layers to the surface of steps as shown in FIGS. 4B, 4C, and 4D.

By applying a surface material with diffracting properties on a the stepped surfaces of a crystalline diffractor made of different material, one can obtain a diffractor which could be used for radiation of two different wave lengths if the diffracting planes in the surface layer and the substrate have different spacings of the diffracting planes. In such a case, it would be preferable to have long wave length radiation diffracted by the surface layers and the more penetrating short wave length radiation diffracted by the substrate.

FIG. 4B shows a diffractor with stepped surfaces in which sheets 31 of a crystalline material such as mica, silicon, quartz and the like are mounted on the surfaces of the steps. It is particularly useful for diffractors having a relatively small number of steps.

FIG. 4C shows a diffractor with stepped surfaces in which flakes 32 smaller than the width of the steps and consisting of a crystalline material are mounted on the surfaces of the steps. The crystalline material might include one of the following: mica, talc, graphite, boron nitride, quartz, lithium fluoride, silicon, ammonium dihydrogen phosphate, ethylenediamine d-tartrate, etc. The advantage of this configuration is the wide applicability to many different crystalline materials commonly used as diffractors in scanning x ray monochromators and the possibility of fabricating diffractors having a large area and a large number of steps.

FIG. 4D shows a diffractor with stepped surfaces in which the surfaces are coated with layers 33 of built-up films. The layers might consist of multilayer soap-like films such as lead stearate, or layered synthetic microstructures, commonly known as LSM. The principle advantage of this configuration is the application to focussing or monochromating long wave length x rays.

I claim:

1. A Bragg diffractor for energetic radiation comprising: a diffracting structure means having doubly curved diffracting planes and a diffracting surface comprising a plurality of steps with surfaces parallel to said diffracting planes; said steps being configured so that the midpoint on the curved surface of each step intercepts the focal circle of a Johansson geometry relating positions of a radiation source, the diffractor and a radiation image point; the surfaces of the said steps having a curvature in the plane of the focal circle equal to twice the radius of the focal circle and the surfaces of the said steps having a curvature perpendicular to the plane of the focal circle corresponding to rotational symmetry about a line passing through the source and image points.

2. A Bragg diffractor as defined in claim 1 in which the diffracting planes comprise the atomic planes of doubly curved single crystal lamellae.

3. A Bragg diffractor as defined in claim 1 in which the diffracting planes are the atomic planes of pieces of doubly-deformed single crystal material affixed to the doubly-curved surface of the steps on a substrate, each of the said pieces having a size equal to the size of the corresponding step.

4. A Bragg diffractor as defined in claim 1 in which the diffracting planes comprise the atomic planes of flakes or grains of single crystal nature affixed to the doubly curved surfaces of steps on a substrate.

5. A Bragg diffractor as defined in claim 1 in which the diffracting planes comprise alternating layers of different x-ray scattering power obtained by sequential deposition of these layers on the doubly curved surfaces of steps on a substrate.

6. A Bragg diffractor for energetic radiation comprising: a diffracting structure means having doubly curved diffracting planes and a diffracting surface comprising a plurality of steps with surfaces parallel to said diffracting planes; said steps being configured so that a point on the curved surface of each step intercepts the focal circle of a Johansson geometry relating positions of a radiation source, the diffractor and a radiation image point for all radial planes about an axis of symmetry; the surfaces of the said steps having a curvature in the plane of the focal circle equal to twice the radius of the focal circle, and the surfaces of the said steps having a curvature perpendicular to the plane of the focal circle corresponding to rotational symmetry about a line passing through the source and image points.

7. A Bragg diffractor as defined in claim 6 in which the diffracting planes comprise the atomic planes of doubly bent single crystal lamellae.

8. A Bragg diffractor as defined in claim 6 in which the diffracting planes are the atomic planes of pieces of toroidally-curved single crystal material affixed to the doubly-curved surfaces of the steps on a substrate, each of the said pieces having a size equal to the size of the corresponding step.

9. A Bragg diffractor as defined in claim 6 in which the diffracting planes comprise the atomic planes of flakes or grains of single crystal nature affixed to the doubly curved surfaces of steps on a substrate.

10. A Bragg diffractor as defined in claim 6 in which the diffracting planes comprise alternating layers of different x-ray scattering power obtained by sequential deposition of these layers on the doubly curved surfaces of steps of a substrate.

11. A Bragg diffractor for energetic radiation comprising: a diffracting structure means having doubly curved diffracting planes and a diffracting surface comprising a plurality of steps with surfaces parallel to said diffracting planes; said steps being configured so that a point on the curved surface of each step intercepts the focal circle of a Johansson geometry relating positions of a radiation source, the diffractor and a radiation focus; the surfaces of the said steps having a curvature in the plane of the focal circle equal to twice the radius of the focal circle; the surfaces of the steps having a curvature perpendicular to the plane of the focal circle corresponding to rotational symmetry about a line passing through a point on the focal circle.

12. A Bragg diffractor as defined in claim 11 in which the point through which the axis of rotational symmetry passes is a point on the focal circle diametrically opposite the midpoint of the diffractor.

13. A Bragg diffractor as defined in claim 11 in which the diffracting planes comprise the atomic planes of doubly curved single crystal lamellae.

14. A Bragg diffractor as defined in claim 11 in which the diffracting planes are the atomic planes of a pieces of doubly-curved single crystal material affixed to the doubly-curved surfaces of the steps on a substrate, each of the said pieces having a size equal to the size of the corresponding step.

15. A Bragg diffractor as defined in claim 11 in which the diffracting planes comprise the atomic planes of flakes or grains of single crystal nature affixed to the doubly curved surfaces of steps on a substrate.

16. A Bragg diffractor as defined in claim 11 in which the diffracting planes comprise alternating layers of different x-ray scattering power obtained by sequential deposition of these layers on the doubly curved surfaces of steps on a substrate.

* * * * *